United States Patent [19]

Wootton

[11] 4,275,260

[45] Jun. 23, 1981

[54] DIELECTRIC GAS MIXTURE CONTAINING TRIFLUORONITROMETHANE AND/OR TRIFLUOROMETHANESULFONYL FLUORIDE

[75] Inventor: Roy E. Wootton, Murrysville, Pa.

[73] Assignee: Electric Power Research Institute, Inc., Palo Alto, Calif.

[21] Appl. No.: 72,344

[22] Filed: Sep. 4, 1979

[51] Int. Cl.[3] ..... H01B 3/56

[52] U.S. Cl. ..... 174/17 GF; 174/31 R; 252/571

[58] Field of Search ..... 252/66, 63.5, 63.7; 174/17 GF, 25 G, 31 R; 200/149 R, 149 A, 148 G, 144 C, 144 R

[56] References Cited

U.S. PATENT DOCUMENTS

| | | | |
|---|---|---|---|
| 3,059,044 | 10/1962 | Friedrich et al. | 174/18 |
| 3,184,533 | 5/1965 | Eiseman | 252/63.5 X |
| 4,071,461 | 1/1978 | Mears et al. | 252/63.5 |

*Primary Examiner*—Harris A. Pitlick

*Attorney, Agent, or Firm*—Flehr, Hohbach, Test, Albritton & Herbert

[57] ABSTRACT

A relatively low-cost dielectric gas mixture including a halogenated hydrocarbon such as $CCl_2F_2$, subject to carbonization in the presence of an electrical discharge, and a minor portion of $CF_3NO_2$ or $CF_3SO_2F$ which suppresses carbonization of the halogenated hydrocarbon.

18 Claims, 1 Drawing Figure

DIELECTRIC GAS MIXTURE CONTAINING TRIFLUORONITROMETHANE AND/OR TRIFLUOROMETHANESULFONYL FLUORIDE

BACKGROUND OF THE INVENTION

The present invention relates to a dielectric gas mixture for use in electrically insulating a conductor.

When high voltages exist between the conductors of electrical apparatus (e.g., transformers, circuit breakers, or switches) arcing or sparking may take place. To prevent this phenomenon, dielectric fluids (gas or liquid) or solids are used to insulate the conductors.

One well-known dielectric gas is sulfur hexafluoride ($SF_6$). While possessing good electric arc interrupting properties, it is relatively expensive, and suffers from relatively low vapor pressures at low temperature and a comparatively high freezing point.

A number of other gaseous compounds have good dielectric properties and are substantially less expensive than $SF_6$ in the form of halogenated alkanes. Many of such gases are fluorinated hydrocarbons used as refrigerants and propellant under the Freon trademark series by DuPont. Such gases included dichlorodifluoromethane ($CCl_2F_2$) and other alkanes substituted with both chlorine and fluorine atoms. However, during the high voltage surges, electrical discharges may occur in apparatus insulated with such gases. Under these conditions, some tend to break down and form free carbon, unless such formation is suppressed. This undesirable occurence is known as carbonization.

Suppression of carbon formation by the addition of $SF_6$ gas and carbon dioxide ($CO_2$) to such halogenated alkanes is disclosed in Mears et al. U.S. Pat. No. 4,071,461. However, these mixtures contain $SF_6$ and so, in some degree, are subject to the aforementioned disadvantages for using that gas.

SUMMARY OF THE INVENTION

It is an object of the invention to utilize the relatively inexpensive halogenated hydrocarbons, particularly fluorinated alkanes, as a major component of a dielectric gas mixture while suppressing its tendency to carbonize. It is a particular object of the invention to utilize a dielectric gas mixture of the foregoing type which will include a suppressant gas of exceptional dielectric strength. Further objects and features of the invention will be apparent from the following description taken in conjunction with the accompany drawing.

In accordance with the above objects, a dielectric gas mixture is provided which includes a halogenated (preferably fluorinated) hydrocarbon subject to carbonization (herein "the carbonizable gas") and either trifluoronitromethane ($CF_3NO_2$) or trifluoromethanesulfonylfluoride ($CF_3SO_2F$) as a carbonizing suppressant gas. Suitable carbonizable gases include many halogenated alkanes, particularly ones including fluorine and chlorine atoms such as $CCl_2F_2$. A typical mixture is 50 to 90 percent of the carbonizing gas and 10 to 50 percent of the suppressant gas. (Unless otherwise specified, percentages herein are on a molar basis.)

BRIEF DESCRIPTION OF THE DRAWINGS

The FIGURE is a graph based upon calculations which plot carbon contents as a function of temperature for dielectric gas mixtures in accordance with the invention.

DETAILED DESCRIPTION OF THE PREFERRED EMBODIMENTS

Figure 1:
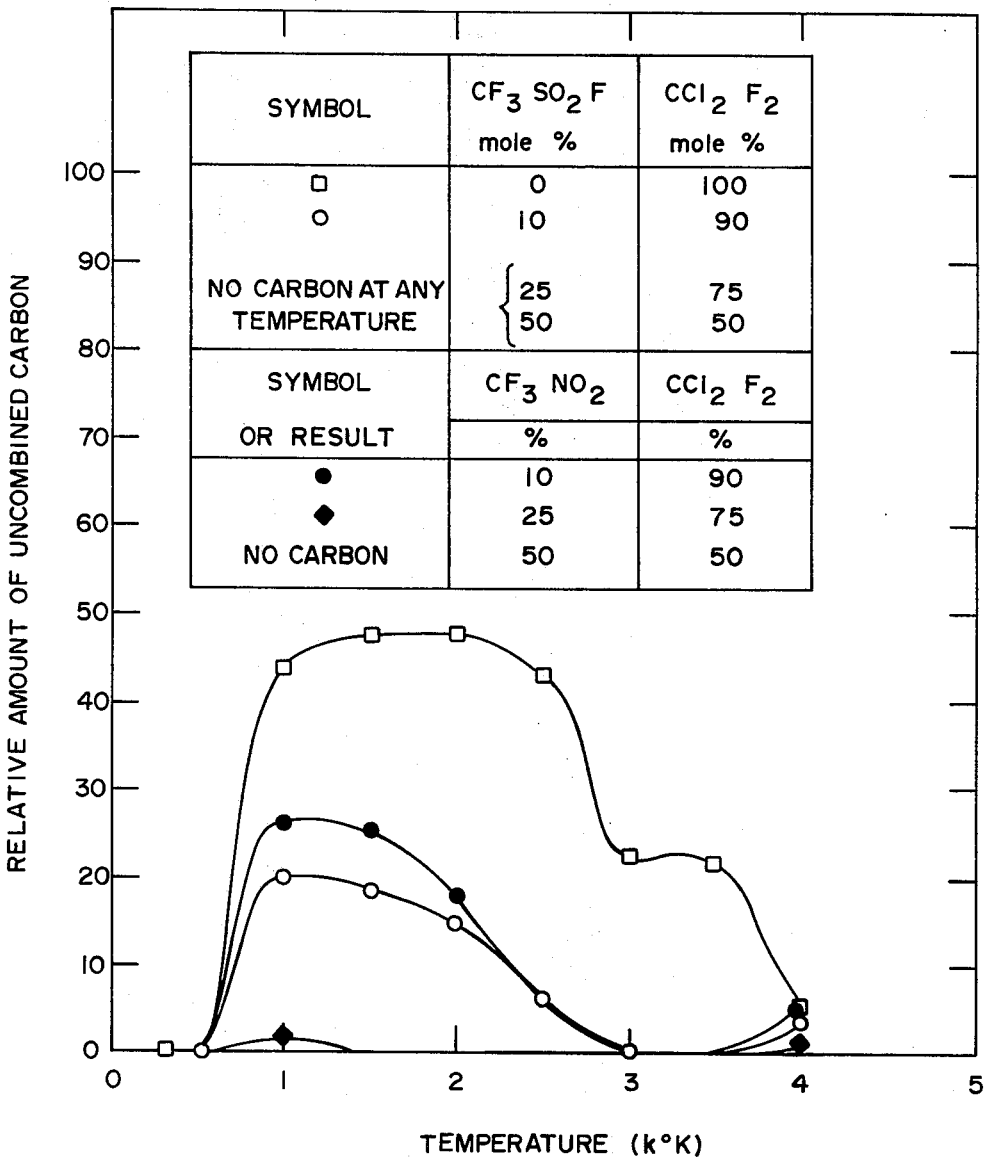

The dielectric gas mixture of the present invention is intended for use in any high-voltage gas-filled electrical apparatus, such as circuit-interrupting apparatus, transformer apparatus, coaxial lines, or the like. The dielectric gas may be used exterior or interior of a conductor in such apparatus and is particularly useful where high voltages exist between conductors where arcing, sparking, and/or discharges may occur. The gas is sealed in the equipment such as in a gas-filled terminal bushing. A suitable terminal bushing construction in which the dielectric gas of the present invention may be utilized can be found in Friedrich et al. U.S. Pat. No. 3,059,044.

The present dielectric gas mixture is intended for use adjacent to the conductor in the above type of electrical apparatus while the conductor carriers an electric current and in which there is a tendency to arc or spark during voltage surges. The gas mixture includes two principal components: (1) a halogenated hydrocarbon gas with a tendency to carbonize in the presence of an electrical discharge, and (2) a carbonizing supressant gas including $CF_3NO_2$ and/or $CF_3SO_2F$.

Referring to the carbonizable gas, a number of halogenated alkanes are relatively inexpensive and have good dielectric strengths. Typical gases of this type include $CCl_2F_2$, $CCl_3$, $CBrF_3$, $CF_3CF_3$, $CClF_2CF_3$. Other suitable ones include $CF_3CF_3CF_3$, $(CF_2)_3$, $CF_3C{\equiv}CCF_3$, and the like.

Some of the carbonizing alkanes substituted with both chlorine and fluorine atoms are particularly desirable because of their high dielectric strength and relatively low cost. A preferred hydrocarbon of this type is $CCl_2F_2$ with desirable characteristics of a dielectric strength approximately equal to that of $SF_6$ and a low flame temperature. Also, although it has a tendency to carbonize, this tendency is relatively low compared to some other halogenated hydrocarbons.

Those halogenated hydrocarbon gases which carbonize, and thus which would take advantage of the suppressing characteristics of the subject suppressant gases, may be determined experimentally. Alternatively, certain theoretical factors have been discovered which assist in determining whether or not the halogenated hydrocarbons will carbonize. For example, it is believed that if the gas molecule includes fluorine atoms in a ratio to carbon atoms of at least 4:1, the gas will not carbonize. At a ratio less than this, the gas is a likely candidate for carbonizing but may not due to the presence of other molecules which suppress carbonizing (e.g., oxygen).

Published experiments illustrate the tendency of selected halogenated hydrocarbons to carbonize. The results of such tests are set out in the following Tabe 1.

TABLE 1

| Gas | Pressure (MPa) | Carbon Formation (1 = None; 10 = Extremely Heavy) |
|---|---|---|
| $CF_4$ | 0.1 | 1 |
| $CF_3CF_2Cl$ | 0.1 | 2 |
| $CF_2Cl_2$ | 0.1 | 3 |
| $CF_3CF_3$ | 0.1 | 3 |
| $CF_3CF_2CF_3$ | 0.1 | 4 |
| $CF_2ClCF_2Cl$ | 0.1 | 4 |
| $CFCl_2CF_2Cl$ | 0.05 | 6 |
| $CF_2{-}CF_2$ / $CF_2{-}CF_2$ | 0.1 | 7 |

TABLE 1-continued

| Gas | Pressure (MPa) | Carbon Formation (1 = None; 10 = Extremely Heavy) |
|---|---|---|
| $CFCl_3$ | 0.1 | 8 |

Another factor bearing on the choice of the carbonizable gas is that it should contain no hydrogen. This is because the gas may be broken down under the effect of an electric discharge. Then, a hydrogen halide could form which is highly corrosive to the environment. This is particularly true for the fluorine containing hydrocarbons in which highly toxic and corrosive hydrogen fluoride would be formed.

The $CF_3SO_2F$ suppressant gas is particularly effective for use in the present invention because it not only suppresses carbonizing of the aforementioned halogenated hydrocarbons, but it also has a particularly high dielectric strength. In quasi-uniform electric fields, the $CF_3SO_2F$ gas was measured to have about a 49 percent greater electrical strength than $SF_6$. Although it has not been experimentally determined, it is believed that the $CF_3NO_2$ suppressant gas will have a similarly high dielectric strength. Each of these two suppressing gases may be used by themselves or, if desired for some purpose, in combination.

A computerized simulation of carbonization was performed based on a calculation of the equilibrium chemical composition of a mixture of atoms in the same porportion as they occur in the gas or mixture being studied at various temperatures and that the initial pressure of the mixture at room temperature. At any given temperature, these atoms will eventually come to a chemical equilibrium with various amounts, which may be essentially zero, of all possible chemicals which can be made from these atoms being present. The free elements may also be formed.

Referring to FIG. 1, such calculations are illustrations plotting calculated carbon formation as a function of temperature for gas mixtures in accordance with the present invention. It is apparent that both the $CF_3SO_2F$ and $CF_3NO_2$ gases serve to suppress carbonization in a particularly effective manner. Referring to the $CF_3SO_2F$ suppressant, carbonization is significantly reduced for $CCl_2F_2$ when the $CF_3SO_2F$ is present at a 10 mole percent while, it is eliminated at a level of 25 mole percent. Thus, suitable calculated amounts of this suppressant are on the order of a lower limit of 10 mole percent while preferable lower limit to eliminate carbonizing is in excess of 10 percent to as high as 25 percent or more.

Referring to the $CF_3NO_2$ results, 10 mole percent of $CF_3NO_2$ significantly reduces the calculated amount of carbonization or $CCl_2F_2$. Based on these calculations, a preferable minimum amount of $CF_3NO_2$ is on the order of 25 mole percent or more.

In considering the computed results, it is noted that the calculations are for an equilibrium state. At high temperatures, equilibrium is reached rapidly, while at room temperatures it may not ever be achieved. An arc produced during a dielectric breakdown test involves rapid cooling. Thus, rapid cooling of 100 percent $CF_2Cl_2$ from 100° K. or more to room temperature "freezes" the composition existing at the high temperature (containing precipitated carbon) and thus carbon remains after the test, even though the equilibrium composition at room temperature contains no precipitated carbon. The variation of the equilibrium carbon content with temperature can be understood in terms of the appearance and disappearance of the various molecular species which can be formed from the atoms present in the mixture. The computerized calculated simulation of FIG. 1 provides an approximation only of the amount of the species which may be present in a given situation.

The proportions of halogenated hydrocarbon to suppressant gas for a particular system can be approximated. This is because carbonization cuts off sharply with increasing content of suppressant. Thus, each gas mix has a critical amount of suppressant. This permits the use of a predetermined amount of suppressant near the critical limit to minimize the amount of the normally more costly suppressant gas in the mix. It is believed that under most conditions a minimum of about 25 percent of $CF_3NO_2$ and 20 percent of $CF_3SO_2F$ should be employed as a safety measure to suppress carbonizing for $CCl_2F_2$. The proportion of the present suppressant gases to be employed with other halogenated hydrocarbon dielectric gases depends upon their propensity to carbonize. Thus, if such other gases have a greater propensity to carbonize, more suppressant gas should be used.

What is claimed is:

1. A dielectric gas mixture comprising a halogenated hydrocarbon gas subject to carbonization in the presence of an electrical discharge and a carbonizing-suppressant gas selected from the group consisting of $CF_3NO_2$, $CF_3SO_2F$, and mixtures thereof.

2. A dielectric gas mixture of claim 1 in which said suppressant gas comprises $CF_3NO_2$.

3. The dielectric gas mixture of claim 1 in which said suppressant gas comprises $CF_3SO_2F$.

4. The dielectric gas mixture of claim 1 in which said carbonizing gas comprises a fluorocarbon.

5. The dielectric gas mixture of claim 1 in which said halogenated hydrocarbon gas comprises a halogenated alkane.

6. The dielectric gas mixture of claim 1 in which said halogenated hydrocarbon gas comprises a fluorinated alkane.

7. The dielectric gas mixture of claim 1 in which said halogenated hydrocarbon gas comprises an alkane substituted with fluorine and chlorine atoms.

8. The dielectric gas mixture of claim 1 in which said carbonizing gas comprises $CCl_2F_2$.

9. The dielectric gas mixture of claim 1 including at least 10 percent of said suppressant gas.

10. The dielectric gas mixture of claim 1 comprising about 50 to 90 mole percent of said halogenated hydrocarbon gas and about 10 to 50 mole percent of said suppressant gas.

11. The dielectric gas mixture of claim 1 comprising about 80 mole percent $CCl_2F_2$ and about 20 mole percent $CF_3SO_2F$.

12. The dielectric gas mixture of claim 1 comprising about 75 mole percent $CCl_2F_2$ and 25 mole percent $CF_3NO_2$.

13. A method for suppressing carbon formation during an electrical discharge in the vicinity of an electrical conductor, which method comprises disposing a dielectric gas mixture adjacent said conductor while it carries an electric current, said mixture comprising a halogenated hydrocarbon carbonizing gas subject to carbonization in the presence of such electrical discharge and a carbonizing suppressant gas selected from the group consisting of $CF_3NO_2$, $CF_3SO_2F$, and mixtures thereof.

14. The method of claim 13 in which said suppressant gas comprises $CF_3SO_2F$.

15. The method of claim 13 in which said halogenated hydrocarbon gas comprises a halogenated alkane.

16. Electrical equipment comprising an electrical conductor and a contained dielectric gas mixture adjacent said conductor, said mixture comprising a halogenated hydrocarbon carbonizing gas subject to carbonization in the presence of an electrical discharge in the equipment and a carbonizing suppressant gas selected from the group consisting of $CF_3NO_2$, $CF_3SO_2F$, and mixtures thereof.

17. The electrical equipment of claim 16 in which said suppressant gas comprises $CF_3SO_2F$.

18. The electrical equipment of claim 16 in which said halogenated hydrocarbon gas comprises a halogenated alkane.

* * * * *